United States Patent [19]

Leivenzon et al.

[11] Patent Number: 4,706,727

[45] Date of Patent: Nov. 17, 1987

[54] DOOR OPERATOR

[75] Inventors: Simon Leivenzon; Zvi Leivenzon, both of Caulfield, Australia

[73] Assignee: Firmagroup Australia Pty. Ltd., Australia

[21] Appl. No.: 732,286

[22] Filed: May 9, 1985

[30] Foreign Application Priority Data

May 11, 1984 [AU] Australia ..... PG4963

[51] Int. Cl.[4] ..... E05F 11/00

[52] U.S. Cl. ..... 160/188; 160/133; 160/310

[58] Field of Search ..... 160/133, 188, 310

[56] References Cited

U.S. PATENT DOCUMENTS

| | | | |
|---|---|---|---|
| 3,439,727 | 4/1969 | Perl | 160/188 |
| 4,172,563 | 10/1979 | Werner et al. | 160/310 X |
| 4,417,185 | 11/1983 | Bullat | 160/310 X |

FOREIGN PATENT DOCUMENTS

| | | |
|---|---|---|
| 528744 | 1/1983 | Australia . |
| 2455160 | 11/1980 | France . |

*Primary Examiner*—Robert W. Gibson, Jr.

*Attorney, Agent, or Firm*—Stevens, Davis, Miller & Mosher

[57] ABSTRACT

A door operator for an overhead garage door having a reversible electric motor and a gear train driving the door. Limit stops are provided, one for the "up" limit and another for the "down" limit. Each of the limit stops is independently zero setable to cut off current to the motor at a pre-selected position.

15 Claims, 8 Drawing Figures

DOOR OPERATOR

FIELD OF THE INVENTION

This invention relates to an improved door operator and relates particularly but not exclusively to such for use in domestic garage doors of the "roll-up" type or the "tilt-up" or "lift-up" type.

DESCRIPTION OF THE PRIOR ART

Hitherto in the art of garage door operator mechanisms it has been necessary for an installer of the operator to accurately adjust the upper and lower limit stops of the door so that power to the driving motor can be removed when the door reaches those positions. Usually this adjustment involves correctly locating limit stop switch means on the door frame in the door opened and door closed positions so that when the door reaches those positions the driving motor can be switched off. Alternatively screw threaded adjusting means have been provided which are arranged on a movable part of an operator mechanism so as to switch off fixed position limit switch means at the respective opened and closed positions. A typical example of such operator mechanism is disclosed, for example, in our Australian Pat. No. 528,744. The disclosure in that Patent Specification is imported herein. That Specification discloses a "roll-up" door operator.

Other forms of operators which are used for "tilt-up" or "lift-up" doors are disclosed for example in U.S. Pat. Nos. 3,439,727 and 4,107,877. The first mentioned U.S.A. Patent Specification discloses a chain drive system where a chain is advanced and/or retreated along a channel member and carries a carriage which slides along the channel member. The carriage is, in turn, connected with an upper part of the door so that the door can be opened when the chain is advanced or closed when it is retreated. The disclosure in the second U.S.A. Patent Specification uses a similar carriage member, but instead of having a chain drive it has a screw thread which rotatably and screw threadably engages with the carriage.

In both of the aforementioned Patent Specifications for the "lift-up" or "tilt-up" doors, complicated adjusting means are provided for the setting of the opened and closed positions of the door so that power to the motor can be removed when the door reaches those positions.

STATEMENT OF INVENTION

The present invention has several aspects and certain embodiments of these will overcome problems of the prior art operators.

Therefore in accordance with a first broad aspect of the present invention there may be provided a door operator with limit stop sensing means, said operator comprising (a) A reversible electric motor for driving the door between the opened and closed positions;

(b) Drive means connected with the reversible electric motor and connectable with said door to effect such opening and closing;

(c) Said drive means including drive releasing means for releasing drive between said reversible electric motor and said door to permit said door to be manually opened in the event of power failure, said limit stop sensing means comprising two driven type limit stop sensors, one being for an "up" or open limit stop and the other being for a "down" or closed limit stop, characterised in that each of said limit stop sensors being zero setable and having respective switch means associated therewith which is only operable when either of said limit stop sensors are at the zero position, said respective stop sensors being connectable with said reversible electric motor to switch off power to said reversible electric motor when operated, whereby said limit stop sensors may be zeroed to set the "up" and the "down" positions respectively, when drive from the motor to said garage door will stop.

For the purposes of this Specification the terms "zeroed" or "zero setable", shall be interpreted to mean, a setting which is at a position where the limit stop sensing means operates, and when ever there is movement away from that set position by the garage door, there will be movement of said switching means away from the zeroed set position.

Most preferably the limit stop sensors are counter means which count "up" and "down" respectively as the door is opened and closed respectively and where they count from or to the zero settings.

It is particularly preferred that the limit stop sensors are drive engaged with the door during the setting of the "up" and "down" stop position limits while said electric motor is drive disengaged.

BRIEF DESCRIPTION OF DRAWINGS

In order that the invention can be more clearly ascertained preferred embodiments will now be described with reference to the accompanying drawings wherein.

DESCRIPTION OF PREFERRED EMBODIMENTS

Figure 1:
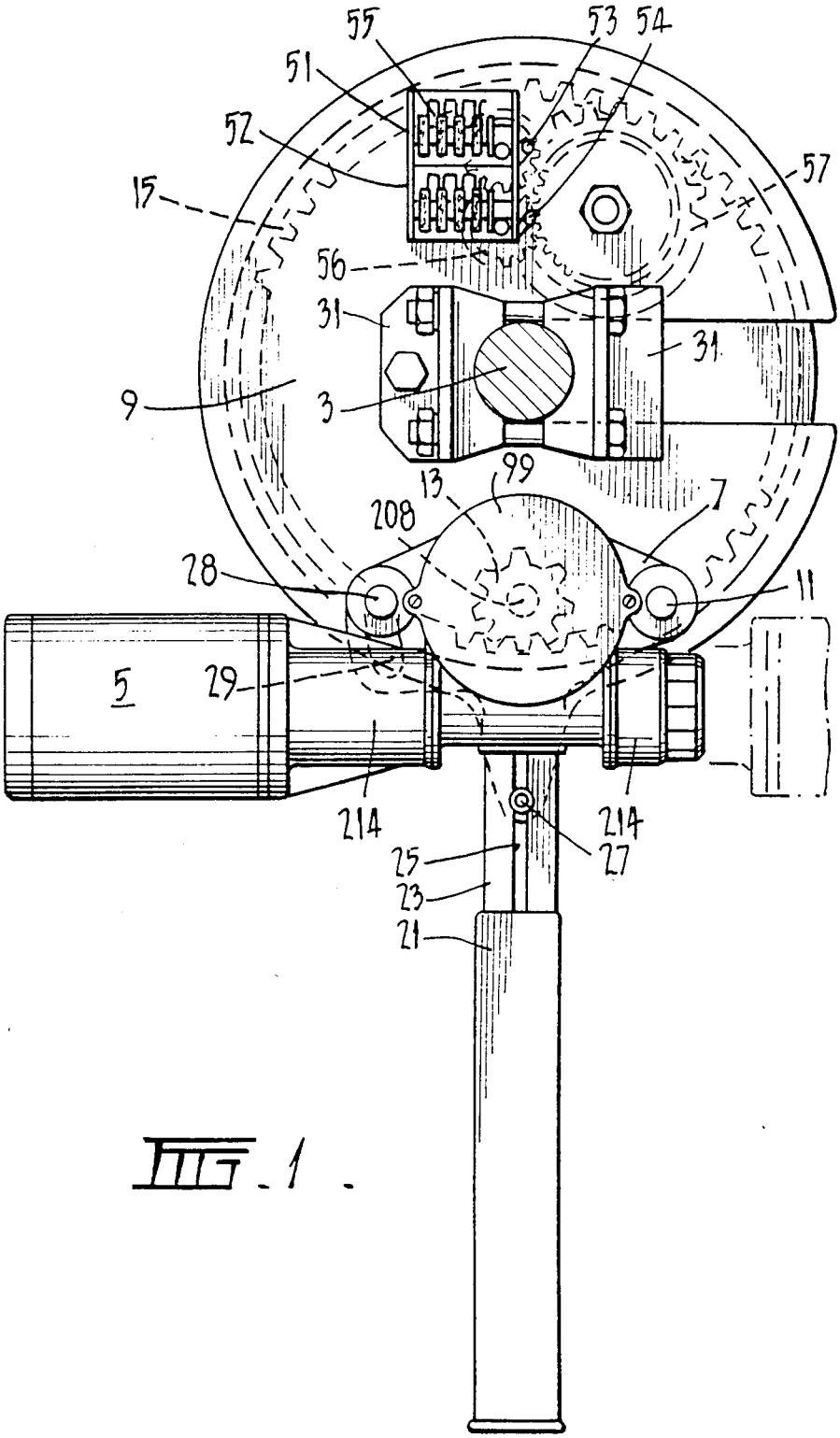
FIG. 1 is a side view of a garage door operator for use with a "roll-up" type garage door.
Figure 2:
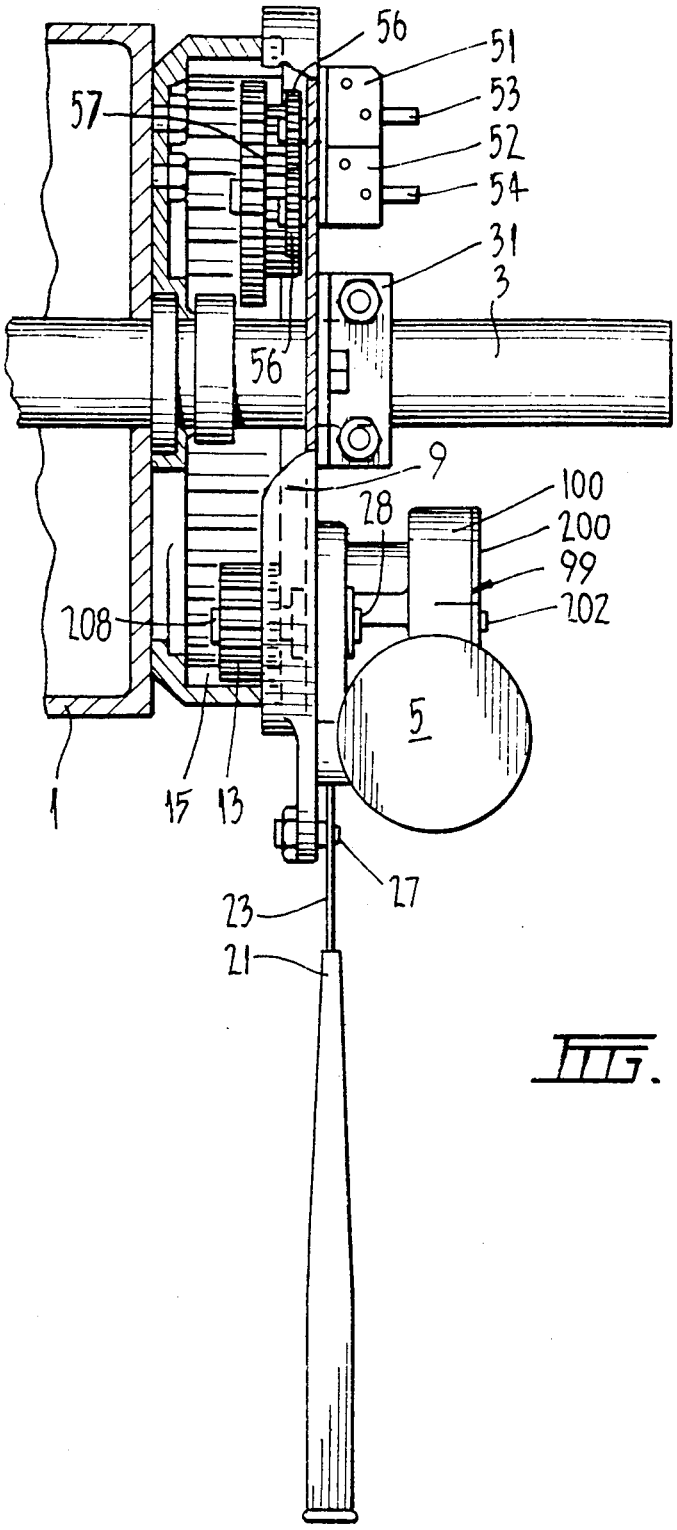
FIG. 2 is an end view of the operator shown in FIG. 1.

Referring firstly to FIGS. 1, 2, 3 and 4 there is shown an operator for a "roll-up" type garage door. In this embodiment the curtain of the door (not shown) is wound onto a drum 1 which is only partly shown in FIG. 2. The drum 1 is mounted for rotation about a fixed axle 3. When the drum 1 is rotated the door curtain is wound either onto or off the drum 1. The drum 1 is, in turn, rotated by an electric motor 5. The motor 5 is a D.C. motor which is reversible in its direction of rotation by reversing the polarity of the voltage supply thereto. Thus, in one direction of rotation the curtain is wound onto the drum 1 while in the other direction of rotation the curtain is wound off the drum. The motor 5 connects with a gearbox shown generally by numeral 99. The gearbox 99 is mounted on an arm 7 which is pivoted to an end plate 9 about a pivot pin 11. The pivot pin 11 is integrally fastened with the end plate 9 and the end plate 9 is, in turn, fastened to the axle 3. The gearbox 99 terminates with a pinion gear 13 which is mounted behind the plate 9 and the pinion gear 13 is drive engageable with an internally toothed rihg gear 15 which is held directly to the end of the drum 1. Thus, as the motor 5 rotates, it in turn, rotates the pinion gear 13 which, in turn, drives the ring gear 15 which causes the drum 1 to rotate about the stationary axle 3. A spring (not shown) urges the arm member 7 in an anti-clockwise direction about the pivot pin 11 so that drive engagement of the pinion gear 13 is effected with the ring gear 15. If the door curtain is to be raised and/or lowered in the event of power failure, then the operator mechanism has a drive disengaging means which permits the pinion 13 to be drive disengaged from the ring gear 15. This occurs by nature of having a handle 21 fastened with the arm member 7. The handle 21 has a thin flexible section 23. The thin flexible section 23 has a central opening 25 therein, and a locating pin 27 integral with the plate 9 locates therein. This maintains the motor in drive engagement with the ring gear 15. When drive is no longer required, the handle 21 is flexed sideways, permitting the locating pin 27 to be released from the opening 25 and then the handle 21 is swung clockwise thereby cranking the arm 7 clockwise so that the pinion gear 13 drive disengages from the ring gear 15. The amount of swinging of the arm 7 is limited by a pin 27 which locates in an elongate arcuate slot 29 at the side of the arm 7 remote from the pivot 11. An operator of this general type is disclosed in our aforementioned Australian Pat. No. 528,744. The disclosure in that Patent Specification is imported herein for the purposes of sufficiency of disclosure in relation to this type of operator generally.

Figure 3:
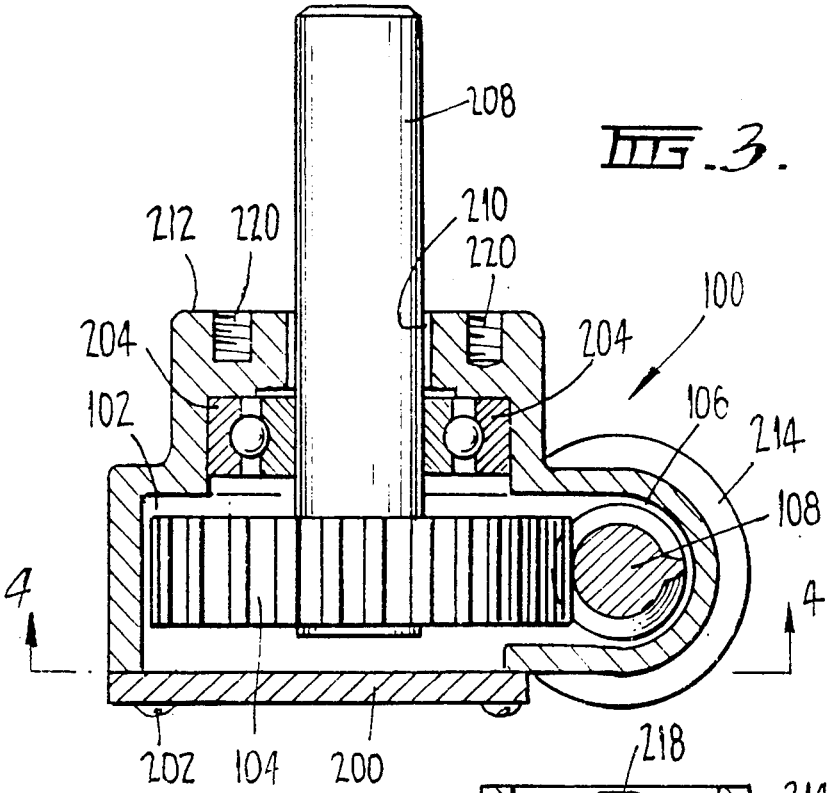
FIG. 3 is a side view of a gearbox used in the operator of FIGS. 1 and 2.
Figure 4:
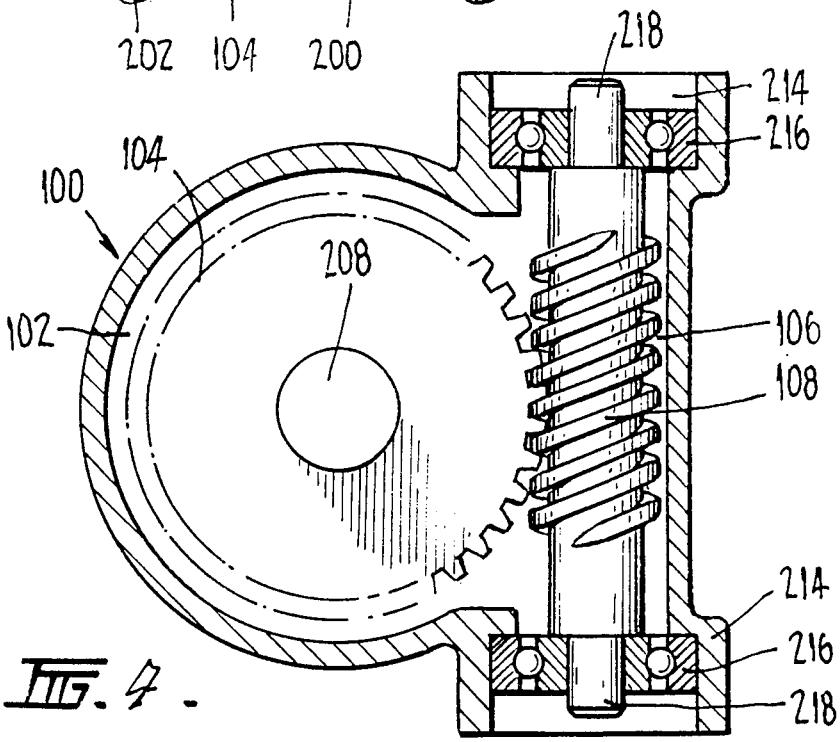
FIG. 4 is a cross-sectional view taken along the line 4—4 of FIG. 3.

In the present embodiment, the gearbox 99 is provided so that a motor 5 can be attached at either the left or right hand side ends or both thereof. This is provided so that an installer of the operator can select which side of the gearbox the motor is to fit, if space is limited, and also, if extra torque is required to wind large door curtains, then two motors 5 can be suitably attached thereto - one at each end of the gearbox 99. The gearbox 99 is shown in FIGS. 3 and 4 and comprises a housing 100. The housing 100 is made of a die-cast metal such as aluminium. It contains a worm drive gearbox mechanism. The housing 100 has a chamber part 102 for receiving a pinion gear 104 and a further chamber part 106 for receiving a worm gear 108. The housing 100 has an open face over the chamber 102 and this is closed by a cover plate 200 which is held thereto by fastening screws 202. The chamber 102 has a recess portion 204 in which a roller bearing 206 is received. The roller bearing 206 carries an axle 208 of the gear 104. Accordingly the gear 104 is positively supported within the chamber 102. The axle 208 extends from the gearbox through an aperture 210 in the rear face 212 thereof. The pinion gear 13 is drive connected therewith.

The chamber 106 has outwardly enlarged chamber parts 214 at each end. These chamber parts are sized to receive roller bearings 216 which support the worm thread 108. The free ends 218 of the worm thread 108 are stepped downwardly and this permits the worm thread 108 to be positively located within the chamber 106 within the bearings 216. The worm thread 108 meshes with the gear 104. The rear face 212 of the housing contains screw fastening apertures 220 which permits the gearbox to be mounted to the arm 7 by screws not shown. The motor 5 can be connected with the free ends 218 of the worm thread. Accordingly an installer can select either end or both ends for the installation of the electric motor(s) 5.

The end plate 9 is carried on the axle 3 and rigidly fastened thereto by clamping brackets 31.

In order to provide limit stops for the fully closed and fully opened positions of the door curtain, there is provided two limit switch means 51 and 52. These switch means 51 and 52 are switch counters which switch off when the counter setting reaches zero. The switches have push button zero resetting button means 53 and 54 which can be used to reset the counter dials 55 to zero. The switch part of the counters is not clearly shown in the drawings but the counter switches are of a type which is known per se. The counters 51 and 52 drive terminate with pinion gears 56 and the pinion gears 56 are arranged to mesh with one another. One of the pinion gears 56 connects with an idler gear 57 and idler gear 57 connects with the ring gear 15. Accordingly as the drum 1 is rotated the counters 51 and 52 are correspondingly rotated. Counter 52 counts in one direction and because the pinion gear 56 thereof meshes with the pinion gear 56 of the other counter 51, the counter 51 then counts in the opposite direction. Therefore, in order to set the fully closed and fully opened positions of the door, the pinion 13 of the gearbox 9 is drive disengaged from the ring gear 15. This enables the door curtain to be freely raised and lowered freely without having to overcome the necessary mechanical advantage drive forces which inhibit movement of the door if the motor 5 is drive connected with the drum 1. The door curtain is then moved to the fully closed position and one of the counters 51 or 52 is then operated via zero the resetting button means 53 or 54 so that it is set to zero. The door curtain is then opened and this causes the drum 1 to rotate to, in turn, cause the counters to index by counting "up" and "down" respectively and then the other of the counters 51 or 52 is caused to be operated by its respective zeroing button means 53 or 54 so as to zero set the "up" position of the door. Accordingly, when the motor 5 is drive engaged with the ring gear 15 the motor will be caused to stop at either the fully closed or fully opened positions of the door because the switches in the counters 51 or 52 are electrically connected in series with the motor. Depending on the current capacity of the switches, and the starting current of the motor, it may be necessary to cause the switches in the counter 51 or 52 to switch further switches which have the required current carrying capacity. The provision of the zero settable counters 51 and 52 very simple resetting of the stop positions. If desired, a user of the operator may preselect stop positions intermediate the fully opened and fully closed positions, simply by depressing the resetting means at desired positions.

Referring now to the embodiment shown in FIGS. 5 through 8 there is shown an operator of the lead screw type used for opening and closing "lift-up" and/or "tilt-up" garage doors such as a type similar to that disclosed in the U.S. Pat. No. 4,107,877 previously referred to. An electric motor 5 is mounted on an end plate 301 of this operator. The end plate 301 is held across an elongate channel member 303 by bracket members 305. The channel member 303 carries a carriage drive means in the form of an elongate screw 307. The screw 307 is held for rotation within the channel member 303. The screw 307 is driven by a double gear wheel 309. The double gear wheel 309 is stepped so that it has an outer diameter toothed part 311 and an inner diameter toothed part 313. The motor 5 terminates in a pinion gear 315 and this pinion is drive engaged with an idler gear 317 which is mounted on a cammed lever 319 so that it can remain in engagement with the pinion gear 315 but can be swung into and out of drive engagement with the gear 309. Thus drive from the motor 5 to the lead screw 307 can be either engaged and/or disengaged by operation of the cammed lever 319. Idler gear 317 is a double gear also. It has outer diameter toothed part 314 and inner diameter toothed part 316. The inner diameter toothed part 316 meshes with the outer diameter toothed part 311 of gear 309 when the lever 319 is moved to the "engaged position". Drive is disconnected when lever 319 is moved to the "disengaged position". Mounted on the plate 301 are two counter switch means 321 and 322 of the same type referred to by numerals 51 and 52 in the previous embodiment. Each of the switch means 321 and 322 comprises a counter with a respective manually resetable zeroing button 323 or 325. The counter switches 321 and 322 are drive terminated with pinions 327, one of which is drive engaged with the inner diameter toothed part 313 of the gear 309. Pinions 327 are in meshing drive engagement with each other and therefore when one of the counter switch means 321 or 322 counts "up", the other will count "down".

Figure 7:
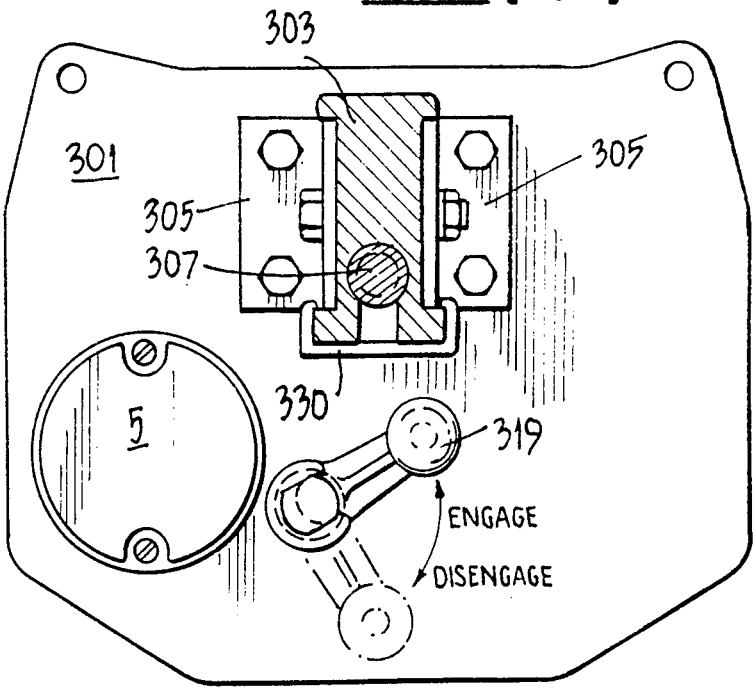
FIG. 7 is an end view taken when looking from the right hand side of FIG. 5.

A carriage 330, shown only in FIG. 7, is carried on the channel 303 and is arranged to be drive engaged with the lead screw 307 by a releaseable lead screw engaging and disengaging latch means (not shown). The exact details of this are immaterial to the present invention but an example of this can be obtained from the aforementioned U.S.A. Patent Specification. The latch means simply comprises a bar member which has a plurality of spaced upstanding teeth thereon. The bar member is mounted to the carriage 330 so that it can be raised so that the teeth will engage with the thread on the screw 307 and lowered so that there is no engagement with the screw 307. Thus drive can be engaged or disengaged. The carriage 330 is, in turn, connected by a link lever (not shown) to the top of the "tilt-up" or "lift-up" door. The electric motor 5 is a D.C. motor and therefore it can be rotated in either direction by appropriate polarity connection of the supply voltage. Thus, the lead screw can be made to rotate in either direction and accordingly the carriage 313 is arranged to be advanced or retreated along the channel 303. Thus, the door will be opened and closed. In order to set the "up" and "down" limits, the door is first closed and this may entail releasing of the releaseable latch means in the carriage 330 to disconnect drive to the screw 307. When the door is "down" the releaseable latch means is engaged and then the cammed lever 319 is swung so that the idler gear 317 disconnects drive from the lead screw 307 to the motor 5. One of the limit switch means 321 and 322 is then zeroed by depressing its manually zero setting button 323 and 325 so that one of the counters is set to zero. The door is then opened and in this connection the carriage is able to slide along the channel member 303 as the mechanical advantage against rotation of the screw 307 is inhibited because the motor 5 is drive disengaged therefrom. Thus, the door is opened whilst maintaining the latch in drive engagement with the screw 307. The screw 307 naturally rotates during this procedure. This then determines the "up" position, and when this position is arrived at, the manually zeroing button 323 or 325 on the relevant one of the other of the limit switches 321 or 322 is depressed, thereby setting the "up" position. The idler gear 317 can then be brought back into drive engagement with the gear 311 by returning lever 319 to the "engaged" position, and the motor 5 will then be switched "off" when the door reaches either the fully closed or fully opened positions. Intermediate opened and closed settings can be obtained by simply depressing the respective push button resetting means 323 and 325 when the door is at those positions.

It will be appreciated that with the present invention, the setting up and/or subsequent alteration of the limit switch positions is very simple. Moreover complicated adjusting means for permitting the limits to be set and accurately maintained is no longer required.

A typical electric circuit diagram for both embodiments is shown in our U.S. Pat. No. 4,452,292 the contents of which are incorporated by reference into this specification.

Figure 5:
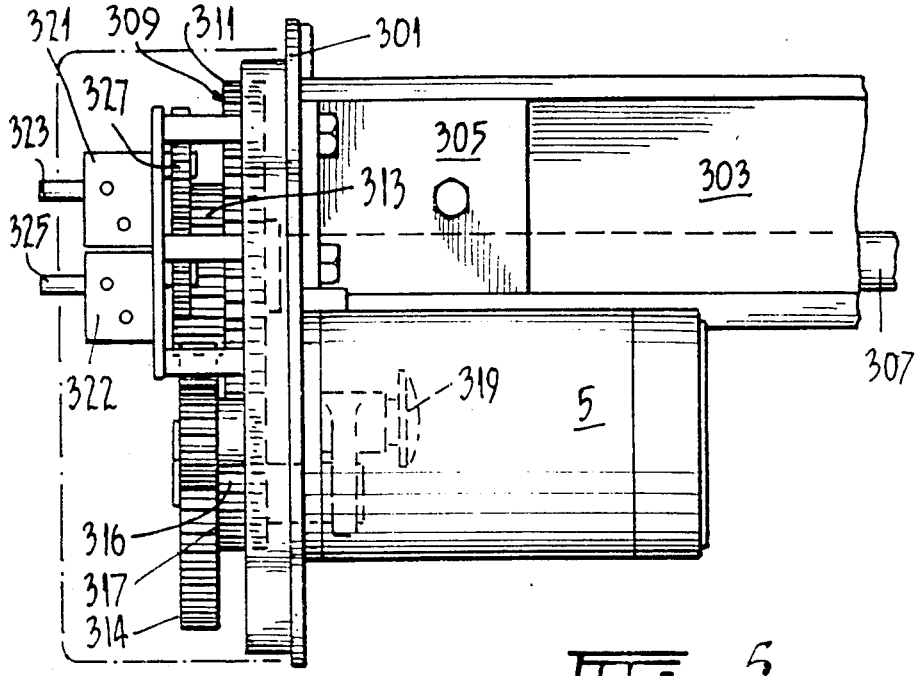
FIG. 5 is a side view of a preferred operator which uses a lead screw for opening and closing a "tilt-up" and/or "lift-up" type garage door.
Figure 8:
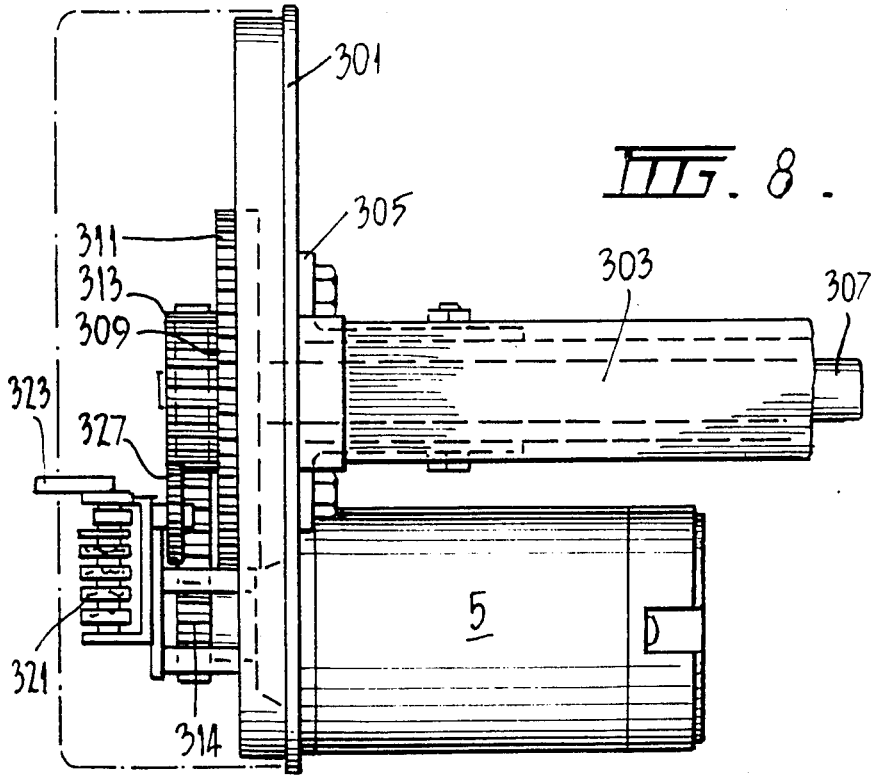
FIG. 8 is a top view of the operator shown in FIGS. 5, 6 and 7.
Figure 6:
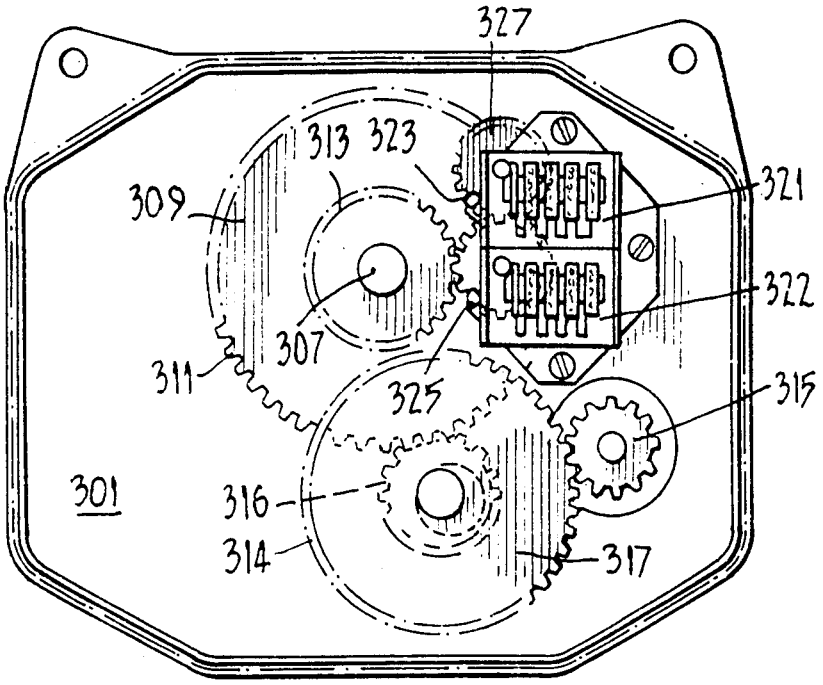
FIG. 6 is an end view taken when looking from the left hand side of FIG. 5.

By using an embodiment similar to that shown in FIGS. 5 through 7 the invention can be applied to a chain drive system for raising and lowering a "tilt-up" type garage door.

Typically the chain drives a carriage along a track, such as the channel member 303. The chain is carried within the channel member 303 and the carriage slides along the channel member in a manner similar to that for the carriage shown in FIG. 7.

The invention is not to be limited to only "roll-up" or "tilt-up" type doors as it is applicable to operators for any doors, windows, or like members which close openings and it should be construed as extending to operators therefor.

Modifications may be made to the invention as would be apparent to persons skilled in the door operator art and these and other modifications may be made without departing from the ambit of the invention the nature of which is to be determined from the foregoing description.

We claim:

1. In a door operator with limit stop sensing means, said operator comprising (a) a reversible electric motor for driving the door between the opened and closed positions;

(b) drive means connected with the reversible electric motor and connectable with said door to effect such opening and closing;

(c) said drive means including drive releasing means for releasing drive between said reversible electric motor and said door to permit said door to be manually opened in the event of power failure, said limit stop sensing means comprising two driven type limit stop sensors, one being for an "up" or open limit stop and the other being for a "down" or closed limit stop, the improvement comprising each of said limit stop sensors being zero setable and having respective switch means associated therewith which is only operable when either of said limit stop sensors are at the zero position, said respective stop sensors being connectable with said reversible electric motor to switch off power to said reversible electric motor when operated, whereby said limit stop sensors may be zeroed to set the "up" and the "down" positions respectively, when drive from the motor to said garage door will stop.

2. A door operator as claimed in claim 1 wherein said door is a roll-up type wherein said operator has a drum onto which the curtain of said roll-up door is wound as the door is opened and further characterised in that said two driven type limit stop sensors are drive engaged with said drum so that as said drum is rotated said two driven type limit stop sensors are directly driven thereby.

3. A door operator as claimed in claim 2 further characterised in that said two driven type limit stop sensors are drive engaged with each other and wherein drive from said drum is directly to only one of said two driven type limit stop sensors, the drive engagement therebetween permitting the drive of the respective driven type limit stop sensors to be in the opposite direction to each other.

4. A door operator as claimed in claim 1 wherein said door is a tilt-up type door and a carriage is advanceable or retreatable along an elongate channel by said reversible electric motor and wherein said carriage is connected with said door so that as said carriage is advanced or retreated as said door is shut or closed and wherein said carriage is advanced or retreated by drive connecting with a carriage drive means in said elongate channel, further characterised in that said two driven type limit stop sensors are drive engaged with said carriage drive means so that as said carriage drive means is driven, said two driven type limit stop sensors are driven.

5. A door operator as claimed in claim 4 further characterised in that said two driven type limit stop sensors are drive engaged with each other and wherein drive from said drive means is directly to only one of said two driven type limit stop sensors, the drive engagement therebetween permitting the drive of the respective driven type limit stop sensors to be in the opposite direction to each other.

6. A door operator as claimed in claim 4 further characterized in that said drive releasing means between said reversible electric motor and said door comprises a cammed lever which when operated causes a drive wheel intermediate said reversible electric motor and said door to swing into or out of drive engagement with said carriage drive means.

7. A door operator as claimed in claim 5 further characterized in that said drive releasing means between said reversible electric motor and said door comprises a cammed lever which when operated causes a drive wheel intermediate said reversible electric motor and said door to swing into or out of drive engagement with said carriage drive means.

8. A door operator, said operator comprising:

(a) a reversible electric motor for driving the door between the opened and closed positions;

(b) drive means connected with the reversible electric motor and connectable with said door to effect such opening and closing;

(c) said drive means including drive releasing means for releasing drive between said reversible electric motor and said door to permit said door to be manually opened in the event of power failure, (d) limit stop sensing means for an "up" or open stop position and for a "down" or closed stop position, said limit stop sensing means including counting means provided so that when said door is moved to effect opening or closing, said counting means can count whereby to determine the position of said door, and wherein said counting means includes switch means to switch off said reversible electric motor following said counting means counting to predetermined counts which correspond to said "up" or open stop position and said "down" or closed stop position, said counting means being operatively connected with said door so that if said drive releasing means releases drive between said door and said reversible electric motor to permit said door to be manually opened and/or closed in the event of power failure, and said drive releasing means is then operated to resume drive, said predetermined counts will still correspond to the previous set positions.

9. A door operator as claimed in claim 8 wherein said door is a roll-up type wherein said operator has a drum onto which the curtain of said roll-up door is wound as the door is opened and further characterized in that said limit stop sensing means is drive engaged with said drum so that as said drum is rotated said limit stop sensing means is driven thereby.

10. A door operator as claimed in claim 9 further characterized in that said limit stop sensing means are drive engaged with each other and wherein drive from said drum is directly to only one of two limit stop sensing means, the drive engagement therebetween permitting the drive of the respective limit stop sensing means to be in the opposite direction to each other.

11. A door operator as claimed in claim 8 wherein said door is a tilt-up type door and a carriage is advanceable or retreatable along an elongate channel by said reversible electric motor and wherein said carriage is connected with said door so that as said carriage is advanced or retreated as said door is shut or closed and wherein said carriage is advanced or retreated by drive connecting with a carriage drive means in said elongate channel, further characterized in that said limit stop sensing means are drive engaged with said carriage drive means so that as said carriage drive means is driven, said limit stop sensing means are driven.

12. A door operator as claimed in claim 11 further characterized in that said limit stop sensing means are drive engaged with each other and wherein drive from said drive means is directly to only one of two limit stop sensing means, the drive engagement therebetween permitting the drive of the respective limit stop sensing means to be in the opposite direction to each other.

13. A door operator as claimed in claim 11 in which said drive releasing means between said reversible electric motor and said door comprises a cammed lever which when operated causes a drive wheel intermediate said reversible electric motor and said door to swing into or out of drive engagement with said carriage drive means.

14. A door operator as claimed in claim 12 in which said drive releasing means between said reversible electric motor and said door comprises a cammed lever which when operated causes a drive wheel intermediate said reversible electric motor and said door to swing into or out of drive engagement with said carriage drive means.

15. A door operator, said operator comprising:

(a) a reversible electric motor for driving the door between the opened and closed positions;

(b) drive means connected with the reversible electric motor and connectable with said door to effect such opening and closing;

(c) manually operable drive releasing means for releasing drive between said reversible electric motor and said door to permit said door to be manually opened in the event of power failure;

(d) limit stop sensing means for an "up" or open stop position and for a "down" or closed stop position, said limit stop sensing means including counting means provided so that when said door is moved to effect opening or closing said counting means can count whereby to determine the position of said door, and wherein said counting means includes swithc means to switch off said reversible electric motor following said counting means counting to predetermined counts which correspond to said "up" or open stop position and said "down" or closed stop position, said limit stop sensing means being such that even after said drive releasing means has released drive, said perdetermined count values will be maintained so that when said drive releasing means is then operated to resume drive a user of the operator will not be required to reset the relationship between the predetermined count values, the count values of said counting means being user settable to define said "up" or open stop position and said "down" or closed stop position.

* * * * *